US007220128B1

(12) United States Patent
Hicks

(10) Patent No.: US 7,220,128 B1
(45) Date of Patent: May 22, 2007

(54) EXTENDABLE POWER SOURCE DEVICE

(76) Inventor: Miguel Hicks, 1424 Lilycache La., Bolingbrook, IL (US) 60490

( * ) Notice: Subject to any disclaimer, the term of this patent is extended or adjusted under 35 U.S.C. 154(b) by 1 day.

(21) Appl. No.: 11/342,919

(22) Filed: Jan. 30, 2006

Related U.S. Application Data

(60) Provisional application No. 60/649,599, filed on Feb. 4, 2005.

(51) Int. Cl.
*H01R 41/00* (2006.01)

(52) U.S. Cl. ..... 439/32; 439/502

(58) Field of Classification Search ..... 439/32, 439/640, 652, 214, 502, 505
See application file for complete search history.

(56) References Cited

U.S. PATENT DOCUMENTS 2,318,484 A * 5/1943 Herman ..... 439/601

6,004,138 A * 12/1999 Harbertson ..... 439/32

* cited by examiner

*Primary Examiner*—Javaid H. Nasri

(57) ABSTRACT

An extendable power source device for altering the position of a power receptacle on an existing wall electrical outlet is provided. The extendable power source comprises a first receptacle having a front surface and a rear surface and a second receptacle having a front surface and a rear surface. A plug receiving mechanism is formed in the front surface of both the first receptacle and the second receptacle for receiving a plug. A plug mechanism is mounted on the rear surface of the first receptacle. An adjustable bar connects between the first receptacle and the second receptacle. Electrical wiring electrically connects the first receptacle to the second receptacle wherein the first receptacle, the second receptacle, and the adjustable bar are mountable flush against a surface.

20 Claims, 4 Drawing Sheets

EXTENDABLE POWER SOURCE DEVICE

The present application claims benefit of priority of provisional patent application Ser. No. 60/649,599, filed on Feb. 4, 2005, entitled "Extender", now abandoned.

BACKGROUND OF THE INVENTION

1. Field of the Invention

This invention relates generally to an extendable power source device and, more particularly, the invention relates to an extendable power source device which eliminates the need to use an extension cord for relatively short distance power extension applications.

2. Description of the Prior Art

As most home and business owners know, there are never any electrical power outlets where they are needed. Older houses, especially, afford a scarcity of outlets and newer homes are not much better. Newer homes are actually wired to provide many outlets, but the loss of one strategic outlet can leave the homeowner fumbling over extension cords which are actually a safety hazard. It seems to be inevitable, in every type of household and business, that various types of furniture will be positioned in front of receptacles, making it difficult to access the electrical outlet without actually moving the furniture.

As noted above, extension cords are frequently connected to electrical outlets to provide power to other areas of a room. Extension cords are convenient but they can be unsightly and present the risk of an accident resulting from someone tripping over the extension cords.

SUMMARY

The present invention is an extendable power source device for altering the position of a power receptacle on an existing wall electrical outlet. The comprises a first receptacle having a front surface and a rear surface and a second receptacle having a front surface and a rear surface. A plug receiving mechanism is formed in the front surface of both the first receptacle and the second receptacle for receiving a plug. A plug mechanism is mounted on the rear surface of the first receptacle. An adjustable bar connects between the first receptacle and the second receptacle. Electrical wiring electrically connects the first receptacle to the second receptacle wherein the first receptacle, the second receptacle, and the adjustable bar are mountable flush against a surface.

The present invention further includes an extendable power source device for altering the position of a power receptacle on an existing wall electrical outlet. The device comprises a first receptacle having a front surface and a rear surface and a second receptacle having a front surface and a rear surface. Plug receiving means are formed in the front surface of both the first receptacle and the second receptacle for receiving a plug. Plug means are mounted to the rear surface of the first receptacle with the plug means being rotatable three hundred and sixty (360°) degrees. An adjustable bar connects between the first receptacle and the second receptacle. Securement means are mounted on the rear surface of the second receptacle and one side of the adjustable bar for mounting the device to a surface. Electrical wiring electrically connects the first receptacle to the second receptacle, the electrical wiring being routed through the adjustable bar wherein the first receptacle, the second receptacle, and the adjustable bar are mountable flush against a surface.

DETAILED DESCRIPTION OF THE PREFERRED EMBODIMENTS

As illustrated in FIGS. 1–6, the present invention is an extendable power source device, indicated generally at 10, for altering the position of a power receptacle (not shown) on an existing wall electrical outlet (not shown). The extendable power source device 10 is fixedly or releasably securable to any surface including, but not limited to, walls, baseboards, floors, etc.

Figure 1:
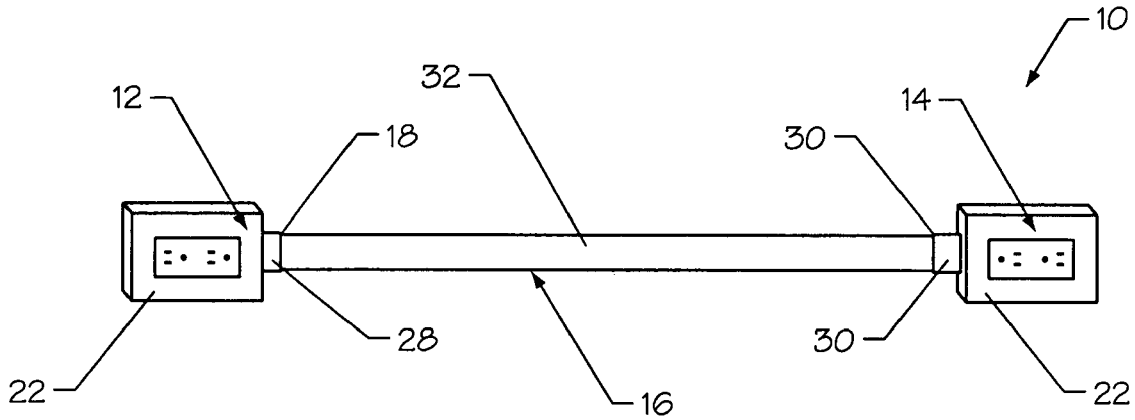
FIG. 1 is a front perspective view illustrating an extendable power source device, constructed in accordance with the present invention, with a first receptacle, a second receptacle, and an adjustable bar.
Figure 2:
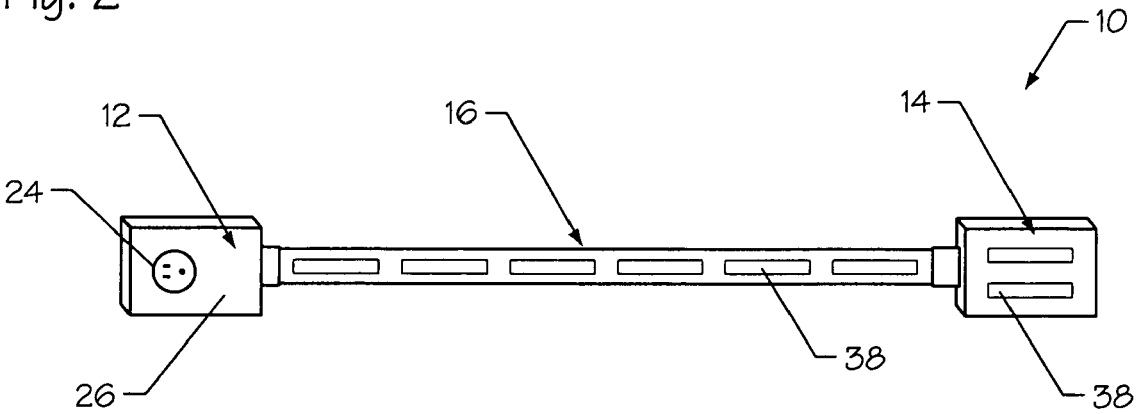
FIG. 2 is a rear view illustrating the extendable power source device, constructed in accordance with the present invention, with a first receptacle, a second receptacle, and an adjustable bar.
Figure 3:
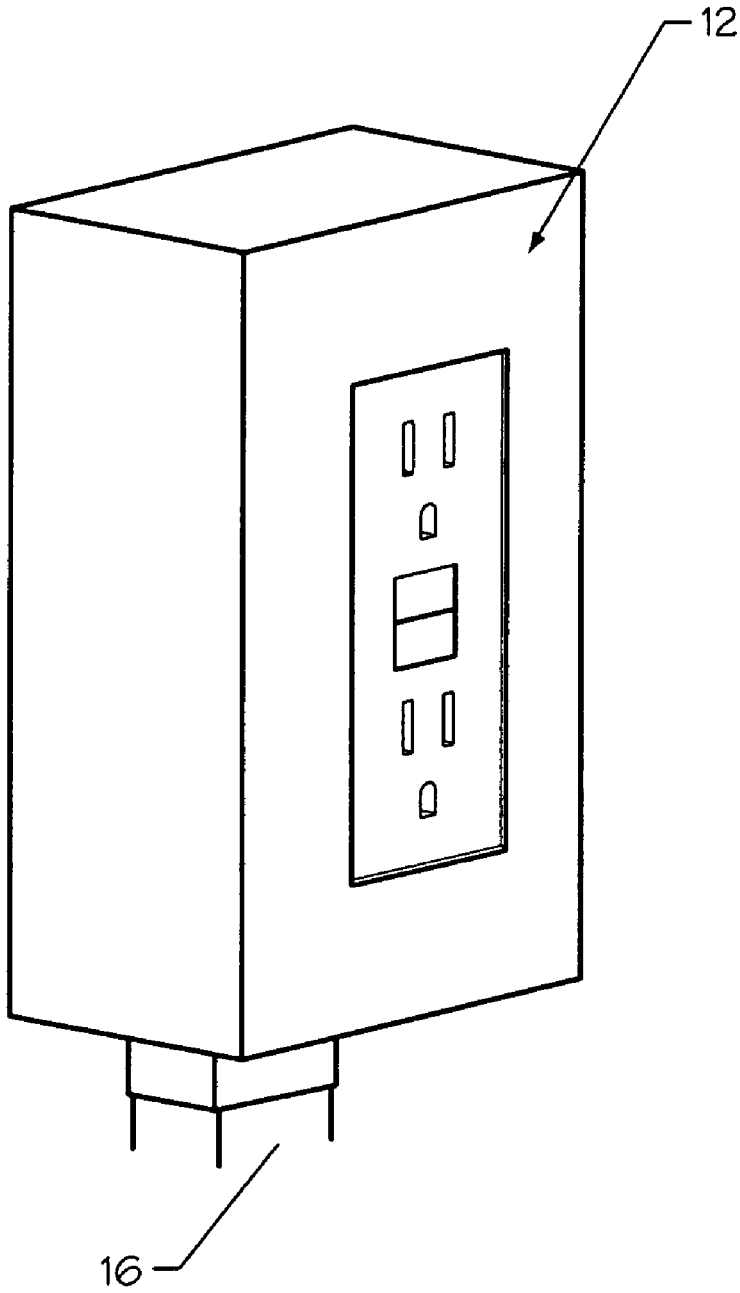
FIG. 3 is a perspective view illustrating a front surface of the first receptacle of the extendable power source device, constructed in accordance with the present invention.
Figure 4:
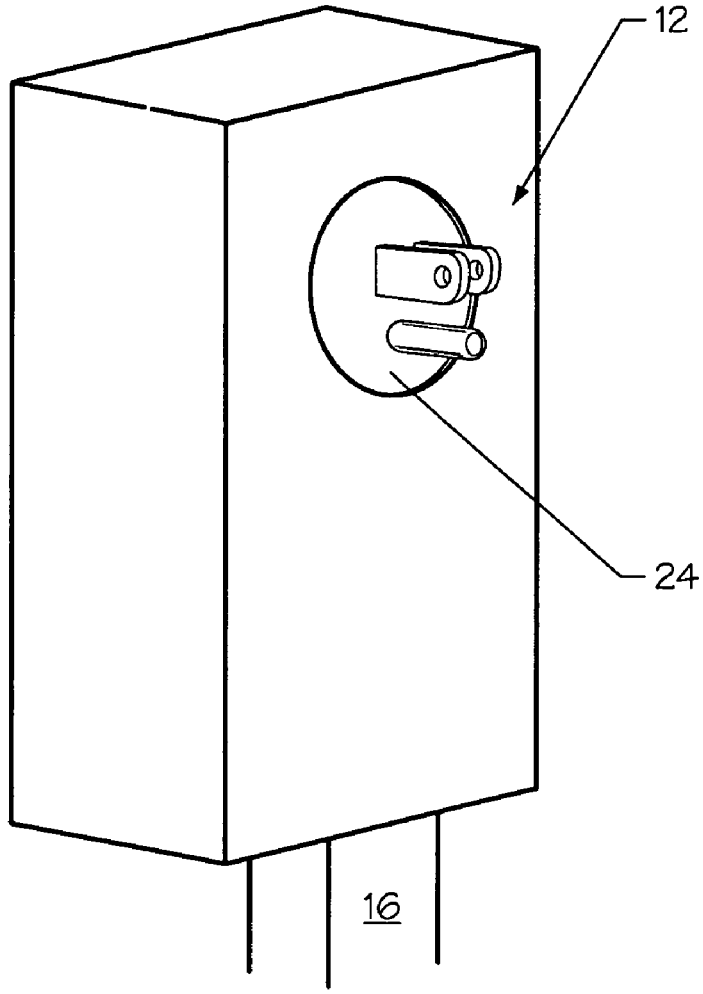
FIG. 4 is a perspective view illustrating a rear surface of the first receptacle of the extendable power source device, constructed in accordance with the present invention.

Referring to FIGS. 1 and 3, the extendable power source device 10 of the present invention includes a first receptacle 12 and a second receptacle 14 connected together by a hollow adjustable bar 16 having a first end 18 and a second end 20. Both the first receptacle 12 and the second receptacle 14 accept standard, three prong (hot, neutral, and ground), male power plugs on a front surface 22. In addition, referring to FIGS. 2 and 4, the first receptacle 12 includes a male power plug 24 rotatable three hundred and sixty (360°) degrees on a rear surface 26 for easily adapting to the original power receptacle on the existing wall electrical outlet. Therefore, the extendable power source device 10 is positionable to the power receptacle regardless of the positioning of the existing wall outlet.

In an embodiment of the present invention, the first receptacle 12 is secured to the first end 18 of the adjustable bar 16 and the second receptacle 14 is secured to the second end 20 of the adjustable bar 16. It is within the scope of the present invention for the first receptacle 12 and the second receptacle 14 to be constructed integral with the adjustable bar 16.

Both the first receptacle 12 and the second receptacle 14 are preferably 110 volts/60 Hertz power outlets with the outer casing of the first receptacle 12 and the second receptacle 14 being constructed from sturdy plastic materials and in a variety of colors. In addition, both the first receptacle 12 and the second receptacle 14 are rated at fifteen (15) amperes or twenty (20) amperes. It should be noted that it is within the scope of the present invention for the first receptacle 12 and the second receptacle 14 to be constructed from other materials and for the voltage, Hertz, and amperage of the first receptacle 12 and the second receptacle 14 to be greater than or less than 110 volts/60 Hertz. In addition, the first receptacle 12 and the second receptacle 14 can be equipped with GFCI.

Furthermore, preferably, the first receptacle 12 and the second receptacle 14 have a substantially rectangular cross-sectional configuration with a width of approximately four and one-half (4½") inches and a height of approximately two and three-quarters (2¾") inches. It should be noted that while the first receptacle 12 and the second receptacle 14 have been described as having particular widths and heights, it is within the scope of the present invention for the first receptacle 12 and the second receptacle 14 to have widths and heights greater than or less than the widths and heights specified herein.

Figure 6:
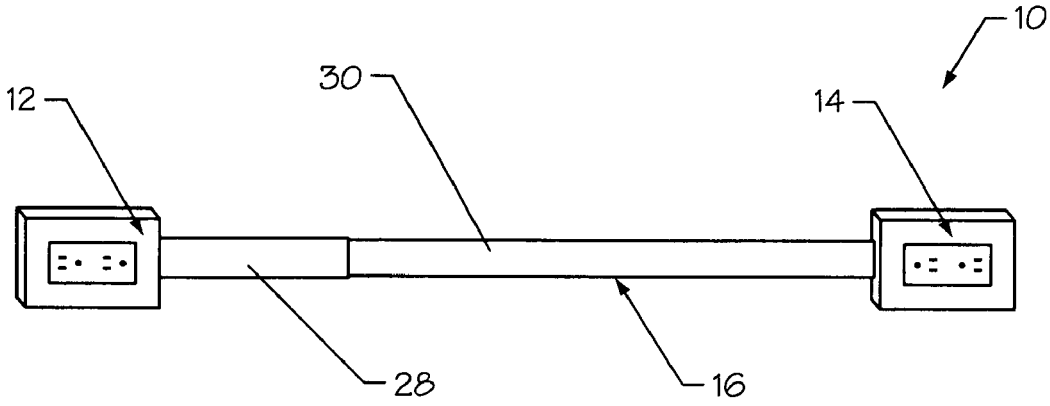
FIG. 6 is a perspective view illustrating another embodiment of the front surface of the first receptacle of the extendable power source, constructed in accordance with the present invention.

As illustrated in FIG. 6, in another embodiment of the present invention, the adjustable bar 16 of the extendable power source device 10 of the present invention preferably has a first adjustable bar portion 28 receivable within a second adjustable bar portion 30. The first adjustable bar portion 28 is slidable relative to the second adjustable bar 30 portion to lengthen or shorten the adjustable 16 bar to the desired length. In this embodiment, the first receptacle 12 is secured to the first adjustable bar portion 28 and the second receptacle 14 is secured to the second adjustable bar portion 30.

Referring back to FIG. 1, in an alternative embodiment, the adjustable bar 16 includes a center adjustable bar portion 32, the first adjustable bar portion 28, and the second adjustable bar portion 30. The first adjustable bar portion 28 is slidable relative to the center adjustable bar portion 32 from the first end 18 of the adjustable bar 16 and the second adjustable bar portion 30 is slidable relative to the center adjustable bar portion 32 from the second end 18 of the adjustable bar 16 to lengthen or shorten the adjustable bar 16 to the desired length. In this embodiment, the first receptacle 12 is secured to the first adjustable bar portion 28 and the second receptacle 14 is secured to the second adjustable bar portion 30.

Figure 5:
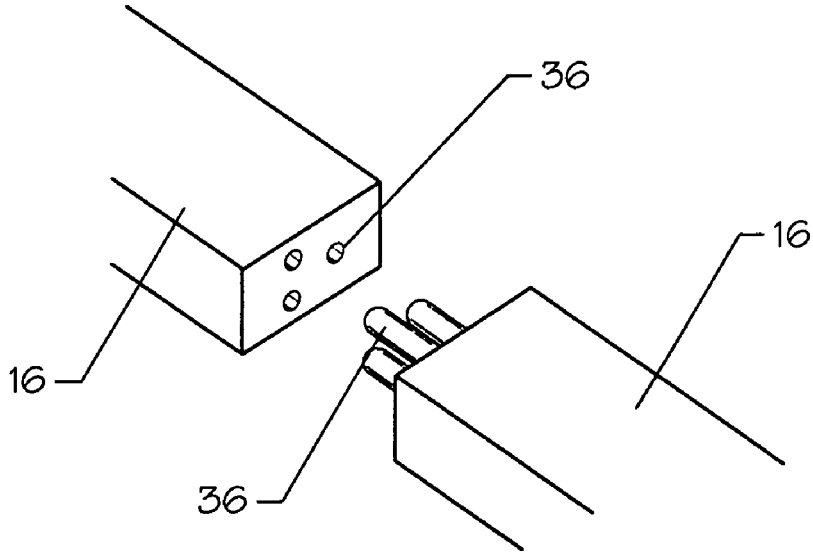
FIG. 5 is a perspective view illustrating connecting adjacent adjustable bars of the extendable power source device, constructed in accordance with the present invention.

Preferably, the adjustable bar 16 has a thickness of approximately three-sixteenths (3/16") inch, a height of approximately three-quarters (¾"), and a length extendable between approximately two (2') feet and five (5') feet. It should be noted that while the adjustable bar 16 has been described as having particular thicknesses, heights, and lengths, it is within the scope of the present invention for the adjustable bar 16 to have thicknesses, heights, and lengths greater than or less than the thicknesses, heights, and lengths specified herein. As illustrated in FIG. 5, for adjustable bar 16 lengths between four (4') feet and eight (8') feet, the ends of the adjustable bars 16 include plugs 34 and receptacles 36 for connecting multiple adjustable bars 16 together.

The extendable power source device 10 of the present invention further includes appropriate electrical wiring (not shown) electrically connecting the first receptacle 12 and the second receptacle 14 in parallel. Preferably, the electrical wiring is routed through the interior area of the hollow adjustable bar 16 for transferring power from the first receptacle 12 to the second receptacle 14.

As illustrated in FIG. 2, furthermore, the extendable power source device 10 of the present invention includes means for securing 38 the first receptacle 12, the second receptacle 14, and the adjustable bar 16 flush against a horizontal or vertical surface. In a preferred embodiment, the means for securing 38 includes at least on strip of two-sided adhesive tape applied to the rear surfaces 26 of the second receptacle 14 and/or the adjustable bar 16. It is preferred that the adhesive tape is not applied to the rear surface 26 of the first receptacle 12 so as not to interfere with the electrical connection between the first receptacle 12 and the original power receptacle on the existing wall electrical outlet. Using more than one strip of the two-sided adhesive tape or other means for securing is within the scope of the present invention.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. An extendable power source device for altering the position of a power receptacle on an existing wall electrical outlet, the device comprising:

a first receptacle having a front surface and a rear surface;

a second receptacle having a front surface and a rear surface;

a first pair of outlets formed in the front surface of the first receptacle and a second pair of outlets formed in the second receptacle, each of the outlets receiving a plug;

plug means are mounted to the rear surface of the first receptacle;

an adjustable bar having a first end and a second end, the adjustable bar connected between the first receptacle and the second receptacle; and electrical wiring electrically connecting the first receptacle to the second receptacle;

wherein the first receptacle, the second receptacle, and the adjustable bar are mountable against a surface; and wherein the first pair of outlets are positioned at the power receptacle and the second pair of outlets are positioned a predetermined distance from the power receptacle.

2. The device of claim 1 wherein the first receptacle is secured to the first end of the adjustable bar and the second receptacle is secured to the second end of the adjustable bar.

3. The device of claim 1 wherein the first receptacle and the second receptacle are integral to the adjustable bar.

4. The device of claim 1 wherein each of the outlets receive a standard, three prong, male power plug.

5. The device of claim 1 wherein the plug means is a standard, three prong, male power plug receivable within the power receptacle.

6. The device of claim 1 wherein the plug means is rotatable three hundred and sixty (360°) degrees.

7. The device of claim 1 and further comprising:

securement means on the rear surface of the second receptacle and one side of the adjustable bar for mounting the device to a surface.

8. The device of claim 7 wherein the securement means are at least one strip of two-sided adhesive tape.

9. The device of claim 1 wherein the adjustable bar has a first adjustable bar portion receivable within a second adjustable bar portion, the first adjustable bar portion slidable relative to the second adjustable bar portion for lengthening or shortening the adjustable bar to a predetermined length, and further wherein the first receptacle is secured to the first adjustable bar portion and the second receptacle is secured to the second adjustable bar portion.

10. The device of claim 1 wherein the adjustable bar has a center adjustable bar portion, a first adjustable bar portion, and a second adjustable bar portion, the first adjustable bar portion slidable relative to the center adjustable bar portion from the first end of the adjustable bar and the second adjustable bar portion slidable relative to the center adjustable bar portion from the second end of the adjustable bar to lengthen or shorten the adjustable bar to a predetermined length, and further wherein the first receptacle is secured to the first adjustable bar portion and the second receptacle is secured to the second adjustable bar portion.

11. The device of claim 1 wherein the adjustable bar is hollow, the electrical wiring being routed through the adjustable bar.

12. The device of claim 1 and further comprising:

a plurality of adjustable bars, each of the adjustable bars having plugs and receptacles for connecting adjacent adjustable bars together.

13. An extendable power source device for altering the position of a power receptacle on an existing wall electrical outlet, the device comprising:

a first receptacle having a front surface and a rear surface;

a second receptacle having a front surface and a rear surface;

a first pair of outlets formed in the front surface of the first receptacle and a second pair of outlets formed in the second receptacle, each of the outlets receiving a plug;

plug means are mounted to the rear surface of the first receptacle, the plug means being rotatable three hundred and sixty (360°) degrees;

an adjustable bar having a first end and a second end, the adjustable bar connected between the first receptacle and the second receptacle;

securement means on the rear surface of the second receptacle and one side of the adjustable bar for mounting the device to a surface; and electrical wiring electrically connecting the first receptacle to the second receptacle, the electrical wiring being routed through the adjustable bar;

wherein the first receptacle, the second receptacle, and the adjustable bar are mountable against a surface; and wherein the first pair of outlets are positioned at the power receptacle and the second pair of outlets are positioned a predetermined distance from the power receptacle.

14. The device of claim 13 wherein the first receptacle is secured to the first end of the adjustable bar and the second receptacle is secured to the second end of the adjustable bar.

15. The device of claim 13 wherein the first receptacle and the second receptacle are integral to the adjustable bar.

16. The device of claim 13 wherein each of the outlets receive a standard, three prong, male power plug.

17. The device of claim 13 wherein the plug means is a standard, three prong, male power plug receivable within the power receptacle.

18. The device of claim 17 wherein the securement means are at least one strip of two-sided adhesive tape.

19. The device of claim 13 wherein the adjustable bar has a first adjustable bar portion receivable within the second adjustable bar portion, the first adjustable bar portion slidable relative to the second adjustable bar portion for lengthening or shortening the adjustable bar to a predetermined length, and further wherein the first receptacle is secured to the first adjustable bar portion and the second receptacle is secured to the second adjustable bar portion.

20. The device of claim 13 wherein the adjustable bar has a center adjustable bar portion, a first adjustable bar portion, and a second adjustable bar portion, the first adjustable bar portion slidable relative to the center adjustable bar portion from the first end of the adjustable bar and the second adjustable bar portion slidable relative to the center adjustable bar portion from the second end of the adjustable bar to lengthen or shorten the adjustable bar to a predetermined length, and further wherein the first receptacle is secured to the first adjustable bar portion and the second receptacle is secured to the second adjustable bar portion.

* * * * *